US005895878A

United States Patent [19]

Ishibashi

[11] Patent Number: 5,895,878

[45] Date of Patent: Apr. 20, 1999

[54] AUTOMATIC ACCOMPANIMENT APPARATUS WITH CONCURRENT CHANGE OF MUSIC STYLE AND ACOUSTIC EFFECT

[75] Inventor: Masao Ishibashi, Hamamatsu, Japan

[73] Assignee: Yamaha Corporation, Hamamatsu, Japan

[21] Appl. No.: 09/001,383

[22] Filed: Dec. 31, 1997

[30] Foreign Application Priority Data

Jan. 9, 1997 [JP] Japan ..... 9-002438

[51] Int. Cl.[6] ..... G10H 1/02; G10H 1/36

[52] U.S. Cl. ..... 84/626; 84/634; 84/662; 84/666

[58] Field of Search ..... 84/609–614, 626–638, 84/662–669, 701–717, DIG. 12

[56] References Cited

U.S. PATENT DOCUMENTS 4,412,471 11/1983 Stier et al. ..... 84/DIG. 12
4,433,601 2/1984 Hall et al. ..... 84/DIG. 12
4,542,675 9/1985 Hall, Jr. et al. ..... 84/DIG. 12
5,142,960 9/1992 Iwase et al. ..... 84/662

FOREIGN PATENT DOCUMENTS 5-273971 10/1993 Japan .

*Primary Examiner*—Stanley J. Witkowski
*Attorney, Agent, or Firm*—Graham & James LLP

[57] ABSTRACT

In a music apparatus, an operator panel designates a first style of automatic play. A tone generator sequentially generates musical tones to produce the automatic play in the designated first style. A DSP applies a first effect to the musical tones in matching with the first style of the automatic play. A CPU operates when the operator panel commands a style change from the first style to a second style during the course of the automatic play for controlling the tone generator to switch the automatic play to the second style. The CPU further operates when the style change necessitates an effect change from the first effect to a second effect matching the second style in a transient period for controlling the DSP before the controlling of the tone generator to complete the effect change within the transient period so that the DSP can apply the second effect to the musical tones timely when the automatic play is switched from the first style to the second style.

14 Claims, 4 Drawing Sheets

AUTOMATIC ACCOMPANIMENT APPARATUS WITH CONCURRENT CHANGE OF MUSIC STYLE AND ACOUSTIC EFFECT

BACKGROUND OF THE INVENTION

1. Field of the Invention

The present invention generally relates to an electronic musical instrument having an automatic accompaniment capability and an effect application capability.

2. Description of Related Art

An electronic musical instrument is configured to execute an automatic accompaniment. The electronic musical instrument can change a style of the currently executed automatic accompaniment to another style. In one change mode, when control information for instructing change of the automatic accompaniment style is reproduced from a storage device during automatic play, the change is executed according to this control information. In another change mode, when the user instructs a style change by predetermined switch operation, a specified new is effected at an end bar of the current measure immediately after the instruction. Sometimes, it is required, in an electronic musical instrument of the above-mentioned type, to change an acoustic effect applied to music tones of the automatic accompaniment to another acoustic effect when a style change operation is conducted. In such a situation, an effect change operation is executed in coincidence with the style change operation.

However, the above-mentioned conventional electronic musical instrument may involve a drawback such as noise generation due to effect change operation when the same is executed during automatic accompaniment. To avoid this drawback, the effect change operation is executed according to steps shown in FIG. 5. To be specific, an effect currently applied is faded out, and then a work memory (RAM) used for effect application is cleared. Next, fade-in is executed to gradually start application of a new effect. These steps inevitably take about 200 ms for the effect change operation to be completed. Consequently, in the above-mentioned conventional electronic musical instrument, when the style change is actually made from an old style to a new style together with the effect change to be made accompanying the style change, it takes time for a new effect to be applied to music tones. This may cause a problem that the new effect is not applied to the first music tone after the style change. For example, when executing effect change operation such that a chorus effect is selected as the style change is made, the chorus effect may not be applied to the first music tone following that style change. This lack of the chorus effect from the first music tone gives the listener the impression that something is out of place. This impression is especially emphasized when an acoustic effect to a percussion instrument tone has been changed.

SUMMARY OF THE INVENTION

It is therefore an object of the present invention to provide an electronic musical apparatus that, when changing an old effect to a new effect after a style of automatic accompaniment has been changed, can apply the new effect without delay.

The inventive music apparatus comprises input means for designating a first style of automatic play, generator means for sequentially generating musical tones to produce the automatic play in the designated first style, effector means for applying a first effect to the musical tones in matching with the first style of the automatic play, style controller means operative when the input means commands a style change from the first style to a second style during the course of the automatic play for controlling the generator means to switch the automatic play to the second style, and effect controller means operative when the style change necessitates an effect change from the first effect to a second effect matching the second style in a transient period for controlling the effector means before the controlling of the generator means to complete the effect change within the transient period so that the effector means can apply the second effect to the musical tones timely when the automatic play is switched from the first style to the second style.

Preferably, the style controller means comprises means operative when the input means commands the style change in middle of a current measure of the automatic play for controlling the generator means to switch the first style to the second style at top of a next measure, and the effect controller means comprises means for controlling the effector means to commence the effect change before the top of the next measure so that the effector means can complete the effect change just at the top of the next measure.

Preferably, the music apparatus further comprises source means operative when the input means commands the style change for feeding music data of the second style to the effect controller means and to the generator means, the music data containing a header portion which indicates the effect change to the effect controller means and a body portion which is sequentially processed by the generator means to produce the automatic play in the second style.

Preferably, the effector means comprises means for completing the effect change within the transient period such that the first effect fades out and then the second effect fades in during the transient period.

BRIEF DESCRIPTION OF THE DRAWINGS

These and other objects of the invention will be seen by reference to the description, taken in connection with the accompanying drawing, in which.

DETAILED DESCRIPTION OF PREFERRED EMBODIMENT

This invention will be described in further detail by way of example with reference to the accompanying drawings. It should be noted that the following preferred embodiment of the present invention will be described using specific terms, such description is for illustrative purposes only, and it is to be understood that changes and variations may be made without departing from the spirit or scope of the appended claims.

Figure 1:
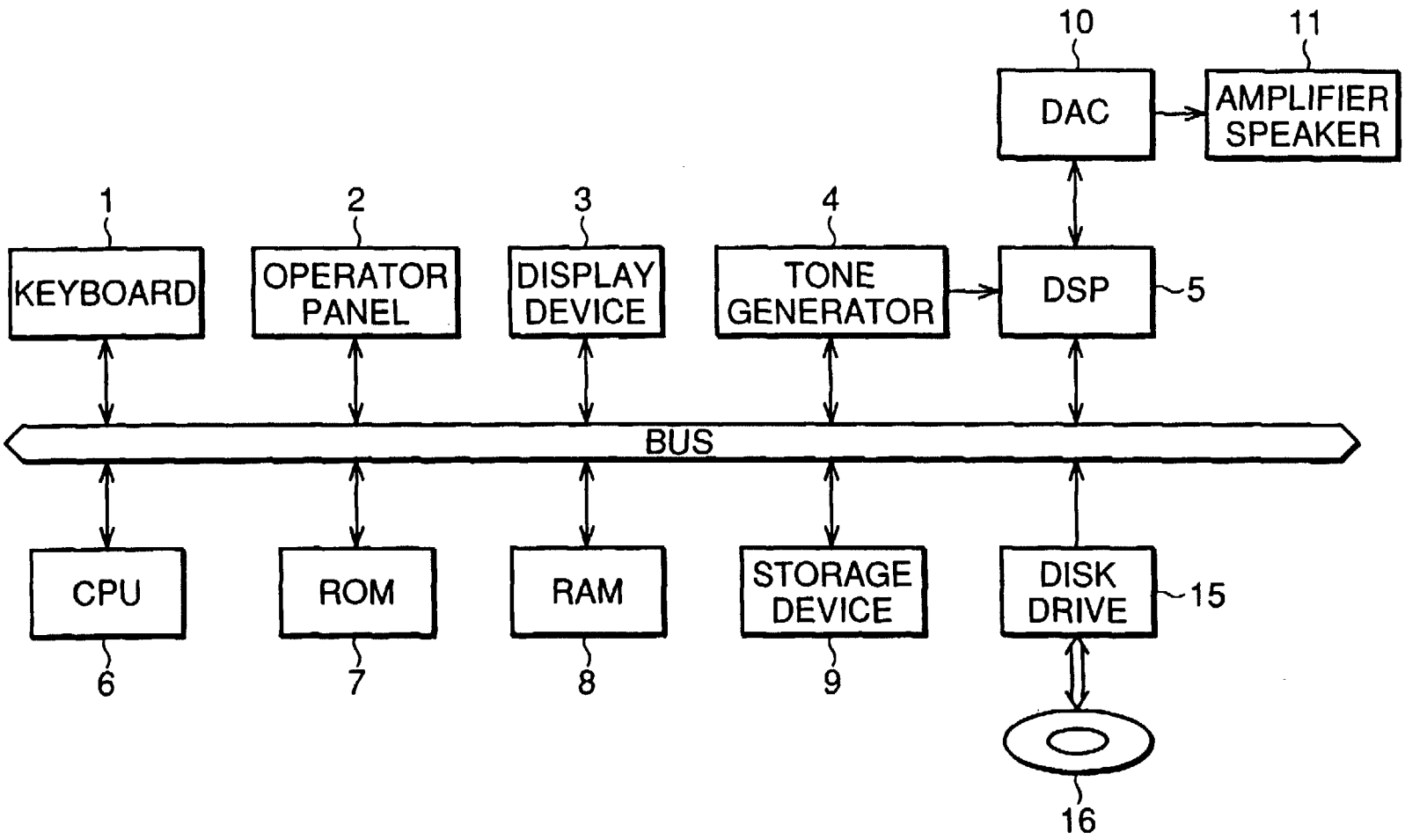
FIG. 1 is a block diagram illustrating constitution of an electronic musical instrument practiced as one preferred embodiment of the invention.

Now, referring to FIG. 1, there is shown a block diagram illustrating constitution of an electronic musical instrument practiced as one preferred embodiment of the invention. In the figure, reference numeral 1 denotes a keyboard, reference numeral 2 denotes an operator panel for style designation, and reference numeral 3 denotes a display device. Reference numeral 4 denotes a tone generator for forming a music tone signal. Reference numeral 5 denotes a DSP (Digital Signal Processor) for applying acoustic effects such as reverberation, chorus, and variation to the music tone signal. The music tone signal given an effect by the DSP 5 is processed by a DAC (Digital Analog Converter) 10, and the resultant signal is outputted from an amplifier speaker 11 as music tones. Reference numeral 6 denotes a CPU (Central Processing Unit) for controlling other components of this electronic musical instrument via a bus. Reference numeral 7 denotes a ROM (Read Only Memory) that stores a control program to be executed by the CPU 6 and various pieces of control information such as parameters for effect application processing. Reference numeral 8 denotes a RAM (Random Access Memory) for use as a work memory of the CPU 6. Reference numeral 9 denotes a storage device for storing music data necessary for automatic accompaniment. Reference numeral 15 denotes a disk drive which receives a machine readable medium 16 such as floppy disk and CD-ROM disk.

In the present embodiment, when the user operates an input composed of the operator panel 2 to instruct execution of automatic accompaniment operation, the corresponding play data or music data is read from a data source composed of the storage device 9 by means of a controller made of the CPU 6. According to this play data, the automatic accompaniment operation is executed. If the user instructs change of a style of the automatic accompaniment by means of the operator panel 2, style change processing is executed. If change of effects is required, effect change processing is also executed.

Figure 2:
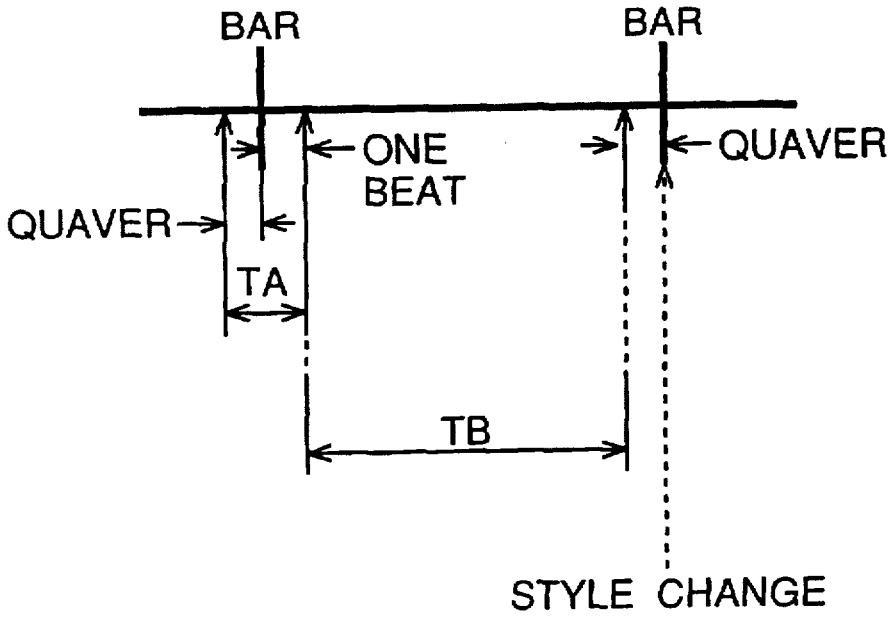
FIG. 2 is a diagram illustrating the outline of effect change processing accompanying style change in the preferred embodiment of FIG. 1.

FIG. 2 shows the outline of the style change processing and the effect change processing. In the present embodiment, the CPU 6 that controls the progress of the automatic accompaniment operation conducts both the style change processing and the effect change processing. The control sequence depends on when a style change instruction is given. To be specific, the CPU 6 is always monitoring the progress of each measure of the automatic accompaniment operation. When a style change instruction is given, the CPU 6 executes the style change processing and the effect change processing by following different sequences according to relationship between a time at which the instruction is given and bars of progressing measures before and after that time.

To be more specific:

(a) if a style change instruction is given during a period TA between a time equivalent to a quaver before a bar and one beat after that bar, the style change processing is executed immediately. If effect processing change is required following the style change processing, the effect change processing is executed immediately after the above-mentioned change instruction is given; or (b) if a style change instruction is given during another period TB which runs after one beat from an immediately preceding bar and has a margin exceeding a time equivalent to a quaver before a succeeding bar, the style change processing is executed at the bar immediately after the instruction is given. At the same time, if effect change processing is required, it is started at a point before a time equivalent to a quaver after the bar at which the style change processing is to be executed.

Figure 3:
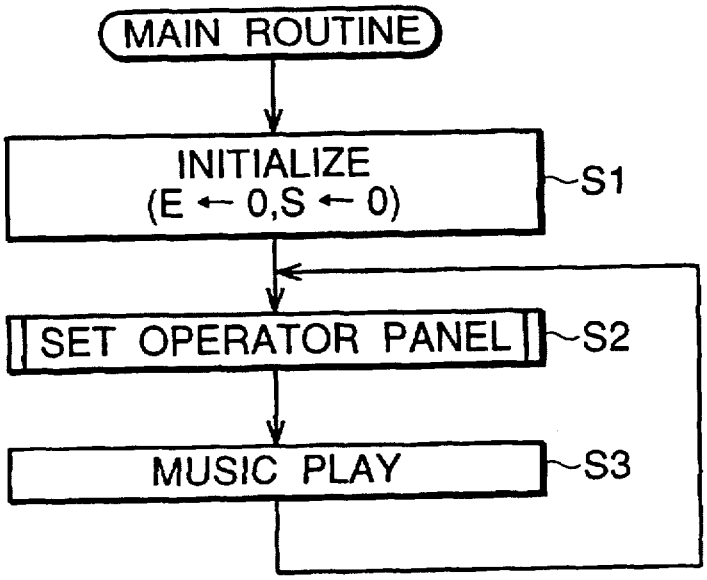
FIG. 3 is a flowchart illustrating operation of the preferred embodiment of FIG. 1.
Figure 4:
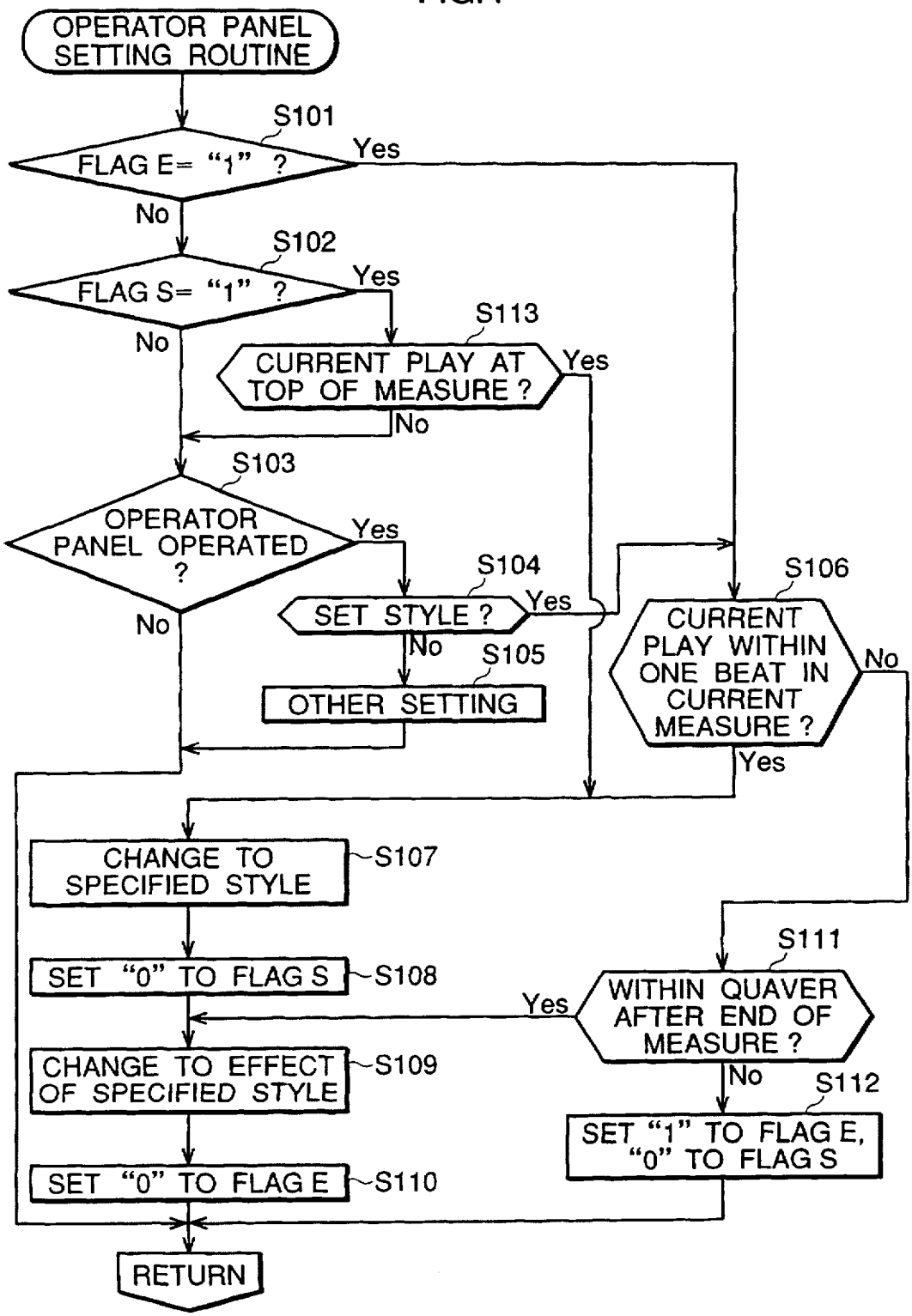
FIG. 4 is another flowchart illustrating operation of the preferred embodiment of FIG. 1.

FIGS. 3 and 4 are flowcharts showing the operation of the electronic musical instrument. The following describes in detail the operation of the present embodiment with reference to these flowcharts. When this electronic musical instrument is powered on, the CPU 6 executes a main routine shown in the flowchart of FIG. 3. First, the CPU 6 initializes various control parameters stored in the RAM 8 (step S1). This initialization sets "0" to each of a flag E for effect change control and a flag S for style change control. If style change is instructed but the change is not to be executed immediately, "1" is set to each of these flags. When the style change processing and the effect change processing have been completed and no further change is required, "0" is set to each of the flags S and E. This flag setting operation will be described later.

Next, the CPU 6 executes an operator panel setting routine (step S2). The operator panel setting routine detects an input operation made on the operator panel 2, and executes processing according to the detected input operation. In addition, if style change has been instructed, the operator panel setting routine executes the sequence control for the specified style change. If required, the routine executes the sequence control for effect change as well.

Then, the CPU 6 executes processing for music play (step S3). To be specific, if the keyboard 1 is operated, the CPU 6 instructs the tone generator 4 to form a music tone signal corresponding to a pressed key. During automatic accompaniment, the CPU 6 instructs the tone generator 4 to form a music tone signal according to the play data read from the storage device 9. When the processing of step S3 comes to an end, then the routine goes back to step S2, and the CPU 6 repeats the processing of steps S2 and S3.

The following describes details of the processing to be executed by the operator panel setting routine (step S2 of FIG. 3) with reference to FIG. 4. First, the CPU 6 determines whether the flag E is "1" or not (step S101). If the decision is NO, then the CPU 6 determines whether the flag S is "1" or not (step S102). If the decision is NO either, the CPU 6 determines whether the operator panel 2 has been operated or not (step S103). If the decision is NO, the CPU 6 returns control to the main routine. Therefore, if the flags E and S are both set to "0" and the operator panel 2 has not been operated, the CPU 6 executes only steps S101 through S103 of FIG. 4 in step 2 of FIG. 3, and therefore does not execute any other processing.

If the user operates the operator panel 2, the decision in step S103 of the operator panel setting routine immediately thereafter becomes YES, and the routine goes to step S104. In step S104, the CPU 6 determines whether a particular key for setting a style has been pressed or not. If the decision is NO, then the CPU 6 executes processing that corresponds to the operated key (step S105), thereby passing control to the main routine.

On the other hand, if the operated key is for style setting, the operator panel setting routine goes to step S106. In step S106, the CPU 6 determines whether the currently performed play is within one beat from the start of a current measure.

Figure 5:
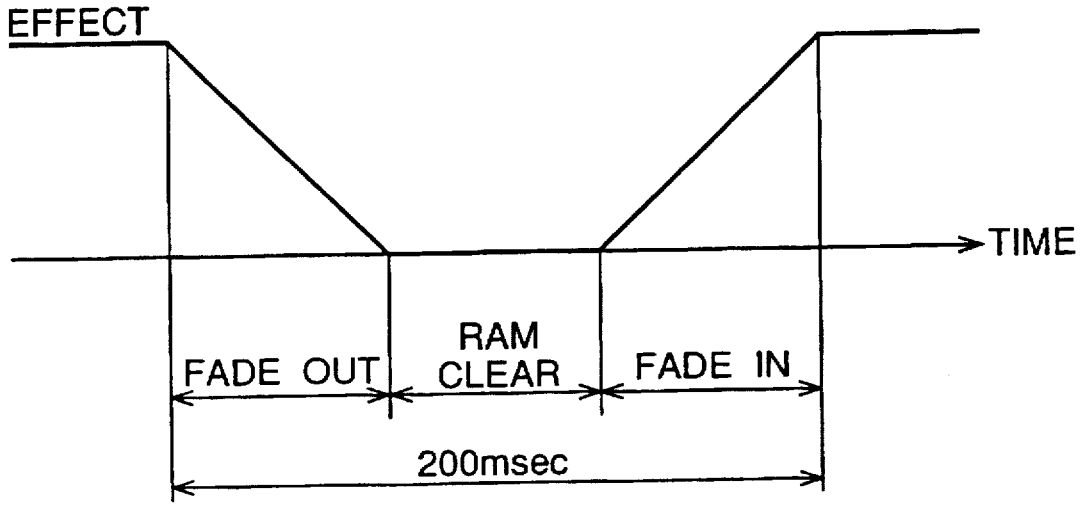
FIG.5 PRIOR ART
FIG. 5 is a diagram illustrating procedure of effect change.

If the decision in step S106 is YES, the CPU 6 changes the style of current automatic accompaniment to the style specified by the key (step S107), and sets "0" to the flag S (step S108). Next, if an effect change is required accompanying this style change, the operator panel setting routine executes the effect change processing (step S109). When the style change has been executed, automatic accompaniment is subsequently executed according the play data corresponding to the newly changed style. Sometimes, the parameter of an effect different from the effect for the automatic accompaniment made so far is set to a style header of this play data. In such a case, the operator panel setting routine sends the parameter of the effect corresponding to this new style to the DSP 5 in step S109 to make change from the old effect to the new effect according to the procedure described with reference to FIG. 5. When the processing of step S109 has been completed, the CPU 6 sets "0" to the flag E (step S110), and passes control to the main routine. It should be noted that, if the effect used in the new style is the same as that of the old style, the effect change processing is not executed in step S109.

On the other hand, if the decision in step S106 is NO, then the CPU 6 determines whether the current automatic play is within the time equivalent to a quaver from the end of the measure (step S111). If the decision is NO, then the CPU 6 sets "1" to the flag E and the flag S (step S112), and passes control to the main routine. That is, if a style change is instructed while the portion of the period TB shown in FIG. 2 is currently played, the style is not changed at that time but the value "1" is set to the flag E and the flag S.

Then, when control is passed from the main routine of step S2 to the operator panel setting routine in the next cycle, the operator panel setting routine goes from step S101 to step S106 because the flag E is set "1." Further, the operator panel setting routine goes from step S106 to step S111. Until the period TB shown in FIG. 2 lapses, a cycle in which control is passed to the main routine via step S111 and step S112 is repeated.

When the time equivalent to the quaver from the end of the measure reaches, the operator panel setting routine in that cycle goes from step S101 to step S106 and then to step S111, in which the decision turns YES, whereby the routine branches to step S109. In step S109, before changing to the specified style, the CPU 6 executes an effect change operation necessary for the style change. To be specific, as described with reference to FIG. 5, the CPU 6 starts the effect change processing according to the sequential procedure of fading out, RAM clearing, and fading in. It should be noted that, as described, if the effects before and after style change are the same, this change processing is not executed. When the processing of step S109 is completed, the CPU 6 writes "0" to the flag E (step S110), and passes control to the main routine.

When control is passed from step S2 of the main routine to the operator panel setting routine in the following cycle, the operator panel setting routine goes to S113 via step S101 and step S102 because the flag E is "0" and the flag S is "1." In step S113, the CPU 6 determines whether the currently played portion is the head of the measure. If the decision is NO, then the operator panel setting routine goes to step S103, in which the processing corresponding to the panel operation done is executed, and control is passed to the main routine. Then, when the automatic play reaches the bar, the operator panel setting routine in that cycle goes from step S101 to step S102 to step S113, in which the decision is YES, and to step S107. In step S107, the CPU 6 changes the old style to the new style specified by the user from the operator panel. At the time of this style change processing, the effect change processing started before the time equivalent to the quaver from the bar has been completed. Therefore, after the style change processing, the new effect corresponding to the new style is applied to the music tone signal. When the processing of this step S107 is completed, the operator panel setting routine goes to step S108, step S109 and step S110, and then control is passed to the main routine. In this case, the effect change processing accompanying the style change processing has already been executed, so that the effect change processing in step S109 is not executed.

In the inventive music apparatus or the electronic musical instrument, input means such as the keyboard 1 and the operator panel 2 designates a first style of automatic play. Generator means in the form of the tone generator 4 sequentially generates musical tones to produce the automatic play in the designated first style. Effector means is composed of the DSP 5 for applying a first effect to the musical tones in matching with the first style of the automatic play. Style controller means composed of the CPU 6 operates when the input means commands a style change from the first style to a second style during the course of the automatic play for controlling the generator means to switch the automatic play to the second style. Effect controller means also composed of the CPU 6 operates when the style change necessitates an effect change from the first effect to a second effect matching the second style in a transient period for controlling the effector means before the controlling of the generator means to complete the effect change within the transient period so that the effector means can apply the second effect to the musical tones timely when the automatic play is switched from the first style to the second style.

Preferably, the style controller means comprises means operative when the input means commands the style change in middle of a current measure of the automatic play for controlling the generator means to switch the first style to the second style at top of a next measure, and the effect controller means comprises means for controlling the effector means to commence the effect change before the top of the next measure so that the effector means can complete the effect change just at the top of the next measure.

Preferably, the inventive music apparatus further comprises source means composed of the storage device 9 operative when the input means commands the style change for feeding music data of the second style to the effect controller means and to the generator means. The music data contains a header portion which indicates the effect change to the effect controller means and a body portion which is sequentially processed by the generator means to produce the automatic play in the second style.

Preferably, the effector means comprises means for completing the effect change within the transient period such that the first effect fades out and then the second effect fades in during the transient period.

Further, the invention covers the machine readable medium 16 used for the automatic play apparatus or the music apparatus having the CPU 6. The medium 16 contains program instructions executable by the CPU 6 for causing the automatic play apparatus to perform the steps of designating a first style of automatic play, sequentially generating musical tones to produce the automatic play in the designated first style, applying a first effect to the musical tones in matching with the first style of the automatic play, switching the automatic play to a second style when a style change from the first style to the second style is requested during the course of the automatic play, commencing before switching the automatic play an effect change from the first effect to a second effect matching the second style when the style change necessitates such an effect change, and completing the effect change within a transient period so that the second effect can be applied to the musical tones timely when the automatic play is switched from the first style to the second style.

Preferably, the step of switching comprises switching the first style to the second style at top of a next measure when the style change is requested in middle of a current measure of the automatic play, and the step of commencing comprises commencing the effect change before the top of the next measure so that the effect change can be completed just at the top of the next measure.

As described and according to the invention, effect change processing is executed before style change processing, so that a new effect can be applied to a music tone immediately after an old style has been changed to a new style. This novel constitution consequently streamlines the style change in automatic accompaniment without involving a problem that no effect is applied to the first music tone after style change.

What is claimed is:

1. A music apparatus comprising:

an input that designates a first music style of automatic accompaniment;

a tone generator that sequentially generates musical tones to produce the automatic accompaniment in the designated first music style;

an effector that applies a first acoustic effect to the musical tones in correspondence with the first music style of the automatic accompaniment; and a controller that operates when the input commands a style change from the first music style to a second music style during the course of the automatic accompaniment for controlling the tone generator to switch the automatic accompaniment to the second music style, the controller further operating when the style change necessitates an effect change from the first acoustic effect to a second acoustic effect in a transient period for controlling the effector before the controlling of the tone generator to complete the effect change within the transient period so that the effector can apply the second acoustic effect to the musical tones timely when the automatic accompaniment is switched from the first music style to the second music style.

2. A music apparatus according to claim 1, wherein the controller comprises a section that operates when the input commands the style change in middle of a current measure of the automatic accompaniment for controlling the tone generator to switch the first music style to the second music style at top of a next measure, and another section that controls the effector to commence the effect change before the top of the next measure so that the effector can complete the effect change just at the top of the next measure.

3. A music apparatus according to claim 1, further comprising a data source that operates when the input commands the style change for feeding music data of the second music style to the controller and to the tone generator, the music data containing a header portion which indicates the effect change to the controller and a body portion which is sequentially processed by the tone generator to produce the automatic accompaniment in the second music style.

4. A music apparatus according to claim 1, wherein the effector completes the effect change within the transient period such that the first acoustic effect fades out and then the second acoustic effect fades in during the transient period.

5. A music apparatus comprising:

input means for designating a first style of automatic play;

generator means for sequentially generating musical tones to produce the automatic play in the designated first style;

effector means for applying a first effect to the musical tones in matching with the first style of the automatic play;

style controller means operative when the input means commands a style change from the first style to a second style during the course of the automatic play for controlling the generator means to switch the automatic play to the second style; and effect controller means operative when the style change necessitates an effect change from the first effect to a second effect matching the second style in a transient period for controlling the effector means before the controlling of the generator means to complete the effect change within the transient period so that the effector means can apply the second effect to the musical tones timely when the automatic play is switched from the first style to the second style.

6. A music apparatus according to claim 5, wherein the style controller means comprises means operative when the input means commands the style change in middle of a current measure of the automatic play for controlling the generator means to switch the first style to the second style at top of a next measure, and wherein the effect controller means comprises means for controlling the effector means to commence the effect change before the top of the next measure so that the effector means can complete the effect change just at the top of the next measure.

7. A music apparatus according to claim 5, further comprising source means operative when the input means commands the style change for feeding music data of the second style to the effect controller means and to the generator means, the music data containing a header portion which indicates the effect change to the effect controller means and a body portion which is sequentially processed by the generator means to produce the automatic play in the second style.

8. A music apparatus according to claim 5, wherein the effector means comprises means for completing the effect change within the transient period such that the first effect fades out and then the second effect fades in during the transient period.

9. An automatic play method comprising the steps of:

designating a first style of automatic play;

sequentially generating musical tones to produce the automatic play in the designated first style;

applying a first effect to the musical tones in matching with the first style of the automatic play;

switching the automatic play to a second style when a style change from the first style to the second style is requested during the course of the automatic play;

commencing before switching the automatic play an effect change from the first effect to a second effect matching the second style when the style change necessitates such an effect change; and completing the effect change within a transient period so that the second effect can be applied to the musical tones timely when the automatic play is switched from the first style to the second style.

10. An automatic play method according to claim 9, wherein the step of switching comprises switching the first style to the second style at top of a next measure when the style change is requested in middle of a current measure of the automatic play, and wherein the step of commencing comprises commencing the effect change before the top of the next measure so that the effect change can be completed just at the top of the next measure.

11. A machine readable medium used for an automatic play apparatus having a CPU, the medium containing program instructions executable by the CPU for causing the automatic play apparatus to perform the steps of:

designating a first style of automatic play;

sequentially generating musical tones to produce the automatic play in the designated first style;

applying a first effect to the musical tones in matching with the first style of the automatic play;

switching the automatic play to a second style when a style change from the first style to the second style is requested during the course of the automatic play;

commencing before switching the automatic play an effect change from the first effect to a second effect matching the second style when the style change necessitates such an effect change; and completing the effect change within a transient period so that the second effect can be applied to the musical tones timely when the automatic play is switched from the first style to the second style.

12. A machine readable medium according to claim 11, wherein the step of switching comprises switching the first style to the second style at top of a next measure when the style change is requested in middle of a current measure of the automatic play, and wherein the step of commencing comprises commencing the effect change before the top of the next measure so that the effect change can be completed just at the top of the next measure.

13. A music apparatus comprising:

a tone generator that sequentially generates musical tones to produce an automatic accompaniment containing a sequence of measures;

an effector that applies a first acoustic effect to the musical tones during the course of the automatic accompaniment;

an input that commands an effect change from the first acoustic effect to a second acoustic effect during the course of the automatic accompaniment; and a controller that operates when the input commands the effect change in middle of a current measure of the automatic accompaniment for controlling the effector to commence the effect change before a top of a next measure such that the effector can complete the effect change just at the top of the next measure so that the effector can apply the second effect to the musical tones timely from the top of the next measure.

14. A music apparatus according to claim 13, wherein the effector completes the effect change within a transient period such that the first acoustic effect fades out and then the second acoustic effect fades in during the transient period to complete the effect change at the top of the next measure.

* * * * *